US009727000B2

(12) United States Patent
Kato et al.

(10) Patent No.: US 9,727,000 B2
(45) Date of Patent: Aug. 8, 2017

(54) DETERMINING SURFACE POTENTIAL OF IMAGE BEARING MEMBER OF IMAGE FORMING APPARATUS

(71) Applicant: CANON KABUSHIKI KAISHA, Tokyo (JP)

(72) Inventors: Masahito Kato, Gotemba (JP); Kenta Shibukawa, Mishima (JP); Yusuke Jota, Suntou-gun (JP); Atsushi Toda, Fuji (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/059,474

(22) Filed: Mar. 3, 2016

(65) Prior Publication Data

US 2016/0259263 A1 Sep. 8, 2016

(30) Foreign Application Priority Data

Mar. 6, 2015 (JP) ..... 2015-044552

(51) Int. Cl.
*G03G 15/02* (2006.01)
*G03G 15/00* (2006.01)

(52) U.S. Cl.
CPC ..... *G03G 15/0266* (2013.01); *G03G 15/5037* (2013.01)

(58) Field of Classification Search
CPC ..... G03G 15/0266
See application file for complete search history.

(56) References Cited

U.S. PATENT DOCUMENTS 6,047,144 A * 4/2000 Sasai ..... G03G 15/1675 399/297
8,548,348 B2 10/2013 Sakata et al.
8,718,505 B2 5/2014 Sakata et al.
8,983,317 B2 3/2015 Sakata
(Continued)

FOREIGN PATENT DOCUMENTS

JP 0566638 A 3/1993
JP 2012013381 A 1/2012
JP 2013125097 A 6/2013

*Primary Examiner* — Clayton E Laballe
*Assistant Examiner* — Victor Verbitsky
(74) *Attorney, Agent, or Firm* — Rossi, Kimms & McDowell LLP

(57) ABSTRACT

An image forming apparatus includes a potential detection portion that determines a surface potential of an image bearing member on the basis of an applied voltage value of a detection voltage applied to a voltage application member by a voltage application portion and a detected current value detected by a current detection portion in response to the applied voltage, and a control unit that sets an image formation condition for performing image formation in order to form a toner image on the image bearing member on the basis of the surface potential determined by the potential detection portion. When the surface potential is determined by the potential detection portion, the voltage application portion applies the detection voltage after applying, to the voltage application member, a voltage having an opposite polarity to an image formation voltage that is applied to the voltage application member during image formation.

12 Claims, 11 Drawing Sheets

(56) References Cited

U.S. PATENT DOCUMENTS

| | | | | |
|---|---|---|---|---|
| 2013/0148991 | A1* | 6/2013 | Sakata | G03G 15/0266 399/48 |
| 2015/0362871 | A1* | 12/2015 | Sano | G03G 15/1675 399/66 |

* cited by examiner

FIG.10

| TRANSFER ROLLER | CORRECTION VALUE δV |
|---|---|
| NO CONTAMINATION | 54V |
| TONER CONTAMINATION | 45V |
| TONER CONTAMINATION (AFTER CLEANING) | 49V |
| DURABLE ARTICLE | 35V |

DETERMINING SURFACE POTENTIAL OF IMAGE BEARING MEMBER OF IMAGE FORMING APPARATUS

BACKGROUND OF THE INVENTION

Field of the Invention

The present invention relates to an image forming apparatus that uses an electrophotographic system.

Description of the Related Art

In an image forming apparatus such as a copier, a printer, or a facsimile apparatus that uses an electrophotographic system or an electrostatic recording system, a toner image (a developer image) is formed by supplying toner (developer) to an electrostatic latent image that is formed on an image bearing member by scanning exposure. An image is then formed on a recording material by transferring the toner image onto the recording material and fixing the toner image thereon. In recent years, techniques for suppressing image lightening, scumming, and so on with the aim of stabilizing an output image by controlling the electrostatic latent image on the image bearing member have been proposed.

Japanese Patent Application Publication No. H5-66638, for example, proposes a technique of stabilizing a potential on an image bearing member surface by measuring the potential on the image bearing member surface and feeding the measured potential back to image formation control. Further, Japanese Patent Application Publication No. 2013-125097 and Japanese Patent Application Publication No. 2012-13381 propose a technique of calculating a surface potential by determining a discharge start voltage obtained when a bias is applied to the image bearing member, and feeding the calculated surface potential back to image formation control.

With the configuration described in Japanese Patent Application Publication No. H5-66638, however, the size of the image forming apparatus must be increased in order to measure the surface potential of the image bearing member. With the configuration described in Japanese Patent Application Publication Nos. 2013-125097 and 2012-13381, the surface potential of the image bearing member can be measured without increasing the size of the image forming apparatus. According to research undertaken by the inventors of the present application, however, the precision with which the surface potential is measured may decrease depending on the shape of the member used to measure the surface potential and the manner in which the image forming apparatus is used, and therefore demand remains for an improvement in precision.

SUMMARY OF THE INVENTION

An object of the present invention is to determine a surface potential of an image bearing member with a high degree of precision.

Another object of the present invention is to provide

Further features of the present invention will become apparent from the following description of exemplary embodiments (with reference to the attached drawings).

BRIEF DESCRIPTION OF THE DRAWINGS

FIG. 10 is a table summarizing relationships between a transfer roller in various conditions and a correction value δV, according to the first embodiment.

DESCRIPTION OF THE EMBODIMENTS

Embodiments of the present invention will now be described in detail with reference to the drawings. The dimensions, materials, shapes, relative positions or the like of the components described in the embodiments should be appropriately changed depending on the configuration and various conditions of an apparatus to which the invention is applied, and are not intended to limit the scope of the invention to the following embodiments.

(First Embodiment)

(1) Outline of Configuration and Operations of Image Forming Apparatus

Figure 2:
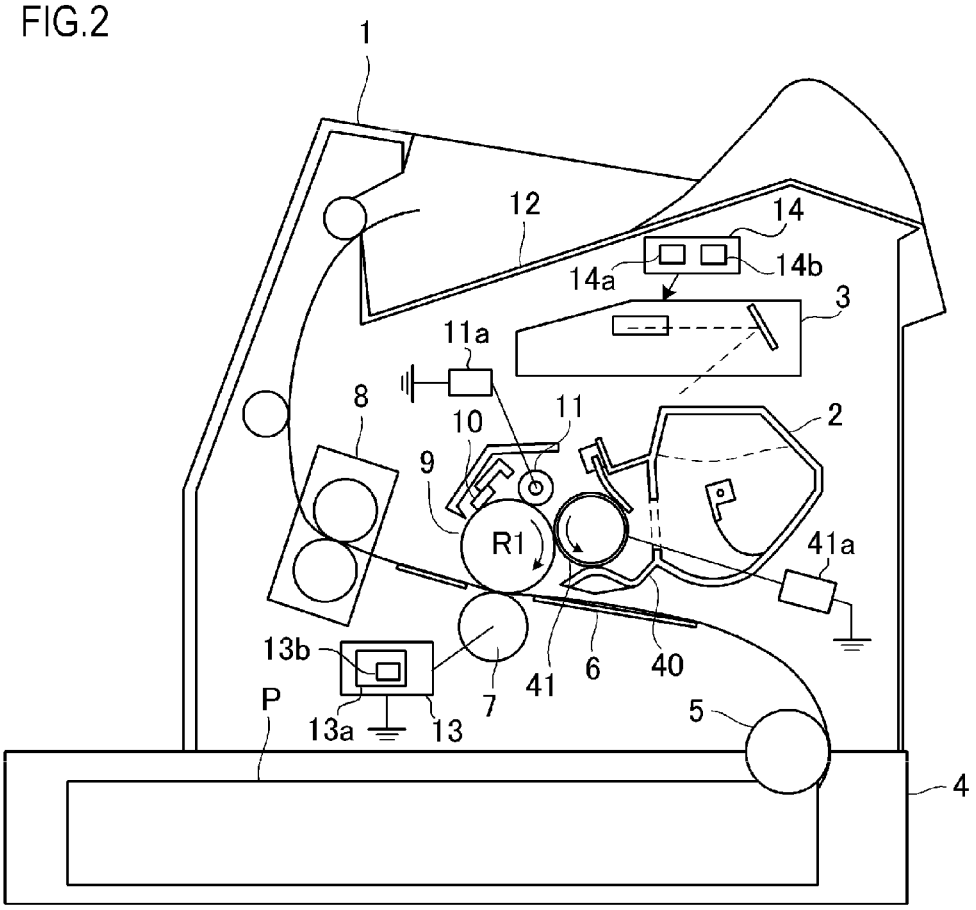
FIG. 2 is a schematic view showing an image forming apparatus according to the first embodiment.

FIG. 2 is a schematic view showing an image forming apparatus according to a first embodiment of the present invention, in which a surface potential of an image bearing member can be measured. The image forming apparatus is a laser beam printer that uses an electrophotographic system. By connecting an external host apparatus such as a personal computer or an image reading apparatus to the printer, image information is received and printed thereby. More specifically, when image information is input into a control circuit unit (a CPU) 14 serving as a control unit from the external host apparatus (not shown), an image is formed on a recording material P and output. The control circuit portion 14 exchanges electric information with the host apparatus and a printer operation unit (not shown), and controls an image formation operation of the image forming apparatus in accordance with a predetermined control program and reference tables stored in a memory (not shown). Image formation sequence control and various other types of control, to be described below, are executed by the control circuit unit 14, and for this purpose the control circuit unit 14 includes a calculation unit 14*a* and a storage control unit 14*b*. The calculation unit 14*a* performs various calculations required to control the image forming apparatus, and serves as a potential detection portion (a calculation portion) of the present invention. The storage control unit 14*b* stores data such as calculation results obtained by the calculation unit 14*a* in a RAM, extracts information required for control and so on from various tables and the like stored in a ROM, and supplies the extracted information to the calculation unit 14*a*. The storage control unit 14*b* thus serves as a storage portion of the present invention. In the following description, calculated values determined on the basis of various detected values and the like using respective calculation formulae may be either calculated (derived) in actual real time or obtained (derived) by referring to a table on which the detected values and so on are associated with the calculated values, the table having been prepared in advance.

1 denotes a printer main body (an image forming apparatus main body), and 2 denotes a process cartridge that can be attached to the printer main body 1 detachably. 9 denotes a drum type electrophotographic photosensitive body (referred to hereafter as a photosensitive drum) that serves as an image bearing member. The photosensitive drum 9 is driven to rotate at a peripheral speed (a process speed) of 147.6 mm/s in a direction indicated by an arrow R1 on the basis of a print start signal. A charging device (a charging roller) 11 to which a charging bias is applied is brought into contact with the photosensitive drum 9 such that a peripheral surface of the rotating photosensitive drum 9 is charged uniformly to a predetermined polarity/potential by the charging device 11. A predetermined charging bias is applied to the charging roller 11 from a charging bias supply source 11*a*. These configurations pertaining to charging of the photosensitive drum 9 correspond to a charging portion of the present invention. An exposure device (a laser scanner unit) 3 performs laser scanning exposure such that the charged surface is exposed to the image information. A laser beam output by the exposure device 3 enters the cartridge such that the peripheral surface of the photosensitive drum 9 is exposed thereto. The exposure device 3 outputs a laser beam that is modulated (ON/OFF modulated) in accordance with times series electric digital pixel signals of the image information input into the controller unit from the host apparatus, thereby subjecting the uniformly charged surface of the photosensitive drum 9 to scanning exposure such that an electrostatic latent image is formed on the peripheral surface of the photosensitive drum. These configurations pertaining to exposure of the peripheral surface of the photosensitive drum 9 correspond to an exposure portion of the present invention. The electrostatic latent image formed by the exposure portion is developed using developer on a developing sleeve (a developing roller) 41 that serves as a developer bearing member of a developing assembly 40. By applying a predetermined developing bias to the developing sleeve 41 using a developing bias supply source 41*a*, negatively charged toner is adhered to the electrostatic latent image on the photosensitive drum 9 and rendered visible in the form of a toner image. These configurations pertaining to development of the electrostatic latent image correspond to a developing portion of the present invention.

Meanwhile, a pickup roller 5 of a sheet tray unit 4 is driven at a predetermined control timing such that one sheet of the recording material (paper) P, which serves as a recording medium that is stacked and housed in the sheet tray unit 4, is separated and fed. As the recording material P passes, via a transfer guide 6, through a transfer roller 7 (a transfer member) disposed in contact with the photosensitive drum, the toner image on the peripheral surface of the photosensitive drum 9 is electrostatically transferred sequentially onto a surface of the recording material P. The toner image on the recording material P is then subjected to heat/pressure fixing processing in a fixing apparatus 8, whereupon the recording material P is discharged onto a discharge tray 12. After the recording material P separates from the peripheral surface of the photosensitive drum 9, the peripheral surface is cleaned by a cleaning device 10 in order to remove residual contaminants such as untransferred toner. The photosensitive drum 9 is then used in a following image formation operation, starting from charging.

Here, a voltage is applied to the transfer roller 7, which serves as the transfer member and a voltage application member of the present invention, from a transfer voltage application circuit 13*a* of the transfer bias supply source 13*a* (a voltage application portion). When the voltage is applied to the transfer roller 7, a voltage (a transfer bias) is applied to the photosensitive drum 9 from the transfer roller 7 via the recording material P, whereby the toner image on the peripheral surface of the photosensitive drum 9 is transferred onto the recording material P. Further, the transfer voltage application circuit 13*a* includes a current detection circuit 13*b* (a current detection portion) that detects a current value flowing through the photosensitive drum 9 via the transfer roller 7 when the voltage is applied to the transfer roller 7.

(2) Outline of Surface Potential Measurement and Determination of Image Formation Process Conditions In the image forming apparatus according to this embodiment, the transfer roller 7 is used as the member (the voltage application member) that detects the surface potential, and therefore the surface potential can be measured without providing an additional member. In this embodiment, first, when image formation is not underway, a surface potential of the photosensitive drum 9 is determined by setting a predetermined charging bias and exposing the photosensitive drum 9 to a predetermined amount of light. A result obtained by measuring this surface potential using a surface potential measurement system is then set as a reference potential. Further, a potential obtained by correcting the reference potential using an actually measured correction value or a predicted correction value is set as a corrected reference potential, whereupon process set values required for optimum image formation are determined on the basis of the corrected reference potential.

Here, the process set values used during image formation serve as image formation process conditions (image formation conditions), and may include the charging bias, the exposure amount, the developing bias, and any other conditions relating to image formation. To suppress image lightening, for example, control such as reducing a DC value of the charging bias, increasing the exposure amount, increasing the DC value of the developing bias, increasing an AC value of the developing bias, and reducing a frequency of the developing bias may be performed. Further, to suppress scumming, control for correcting the developing DC value and the charging DC value in a desired direction in accordance with characteristics of the developing assembly may be performed as well as reducing the AC value of the developing bias, increasing the frequency of the developing bias, and so on.

Hence, information indicating the surface potential of the photosensitive drum is of great importance when determining the image formation process conditions, and therefore the surface potential must be measured accurately. In this embodiment, the surface potential is used as the reference potential, but the reference potential is not limited thereto, and a charging potential prior to exposure maybe used instead. Furthermore, the charging bias and the exposure amount may be set likewise during image formation, but this is not absolutely necessary.

(3) Reference Potential Determination Sequence

First, according to this embodiment, the reference potential is measured. The reference potential is the surface potential of the photosensitive drum when charged by the predetermined charging bias and exposed to the predetermined amount of light and before being corrected by the correction potential.

Figure 3:
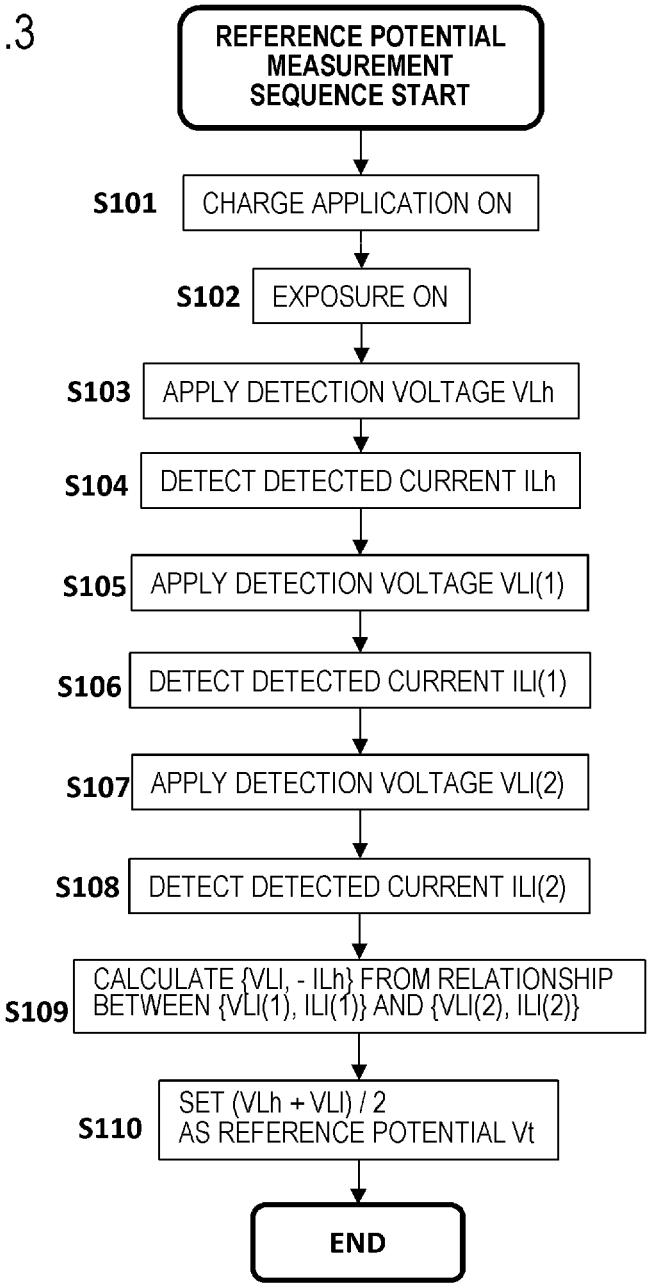
FIG. 3 shows a reference potential measurement sequence according to the first embodiment.

FIG. 3 is a flowchart showing a reference potential determination sequence according to this embodiment. Determination of the reference potential will be described below using FIG. 3.

S101: The photosensitive drum is driven to rotate, and in this condition, the predetermined charging bias is applied thereto. In this embodiment, −500 V is applied as a DC bias.

S102: The charged photosensitive drum is exposed to the predetermined amount of light. In this embodiment, the amount of light is 3 $mJ/m^2$.

S103: A predetermined detection voltage VLh is applied to the transfer roller.

S104: A current value ILh flowing through the photosensitive drum is detected by current detection portion.

S105: A predetermined detection voltage VLl(1) is applied to the transfer roller.

S106: A current value ILl(1) flowing through the photosensitive drum is detected by the current detection portion.

S107: A predetermined detection voltage VLl(2) is applied to the transfer roller.

S108: A current value ILl(2) flowing through the photosensitive drum is detected by the current detection portion.

S109: {VLl, −ILh} is calculated from a linear relationship between {VLl(1), ILl(1)} and {VLl(2), ILl(2)}.

S110: (VLh+VLl)/2 is set as a reference potential Vt.

Figure 4:
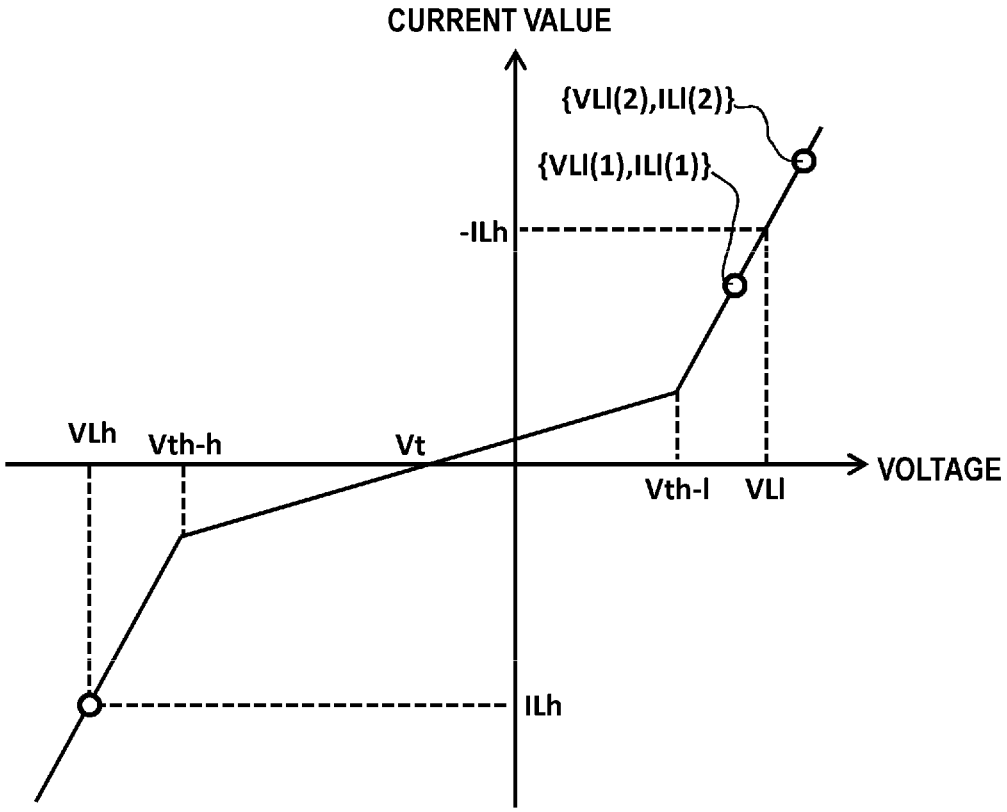
FIG. 4 shows a V-I characteristic of the reference potential measurement sequence according to the first embodiment.

FIG. 4 shows a V-I characteristic of the reference potential determination sequence according to this embodiment. The reference potential determination sequence will be described in further detail below using FIG. 4. As shown in FIG. 4, when a voltage is applied to the photosensitive drum having a certain surface potential, a current flows, and when a voltage having an applied voltage value that exceeds a discharge start voltage value is applied, a discharge current starts to flow. As shown in FIG. 4, this phenomenon occurs similarly when a voltage having an opposite polarity is applied, and therefore Vth-h and Vth-l are observed as the discharge start voltage in relation to the respective polarities. This V-I characteristic is symmetrical about the reference potential, and therefore the reference potential can be calculated using this symmetry. In this embodiment, the reference potential Vt at which the current value flowing through the photosensitive drum reaches zero can be calculated using this symmetry by determining the voltage value VLl at which a current value −ILh flows, the current value −ILh being identical to but having an opposite polarity to the current value ILh that flows when the detected voltage VLh is applied.

Here, as regards the predetermined detection voltages, VLl(1) and VLl(2) are set with respect to VLh as voltages at which opposite direction currents flow, and are both set as voltages within a discharge region. As a result, the voltage value VL1 at which −ILh flows can be determined using the linear relationship between {VLl(1), ILl(1)} and {VLl(2), ILl(2)}.

In this embodiment, the symmetry of the discharge region is used to calculate the reference potential Vt, but instead, for example, two discharge start voltages may be determined and the symmetry thereof may be used. Further, the reference potential can be determined from the symmetry of the discharge region by determining respective voltage values at which predetermined current values having opposite polarities are obtained.

(4) Correction Value Determination Sequence and Transfer Roller Cleaning

Figure 5:
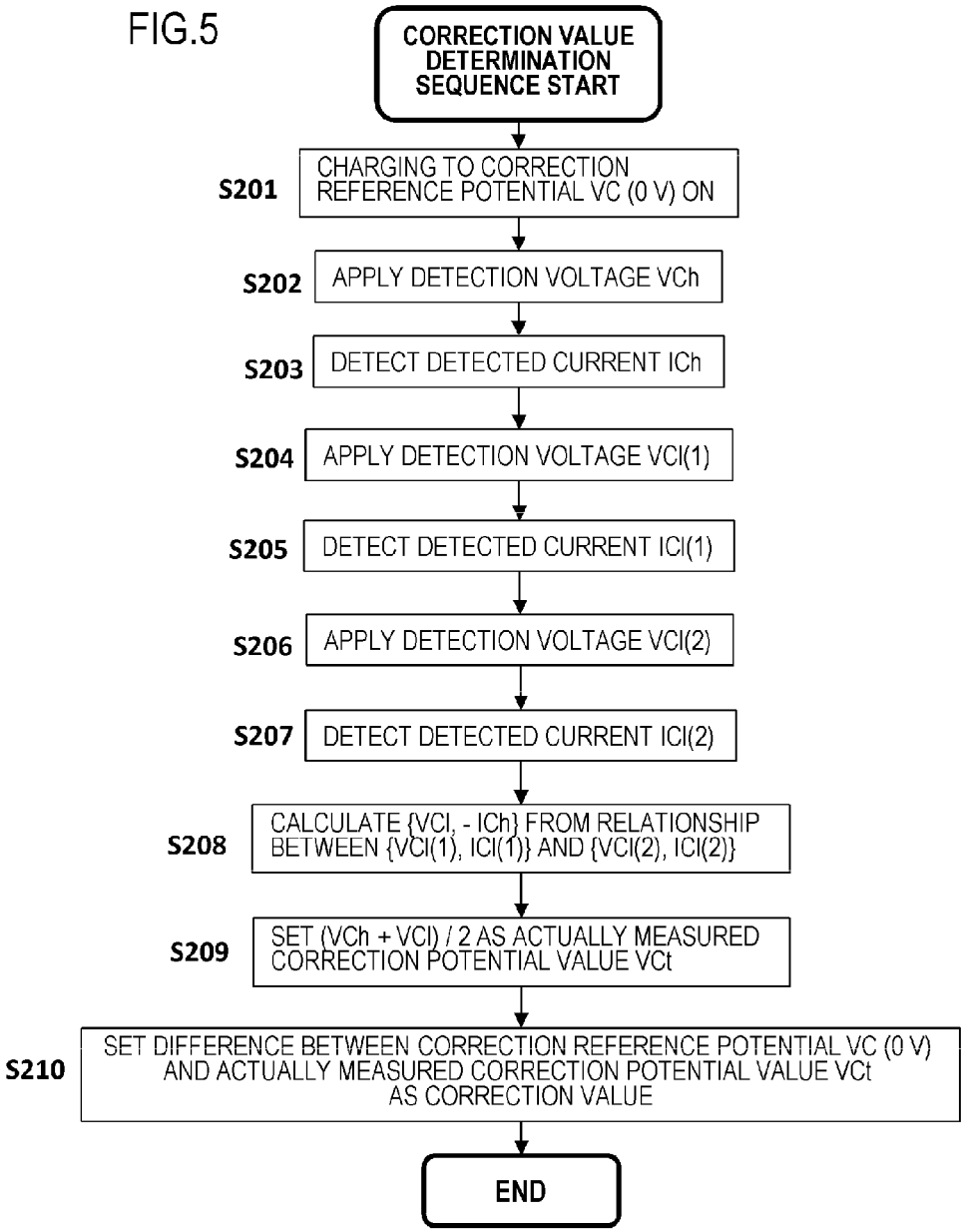
FIG. 5 shows a correction value determination sequence according to the first embodiment.

FIG. 5 is a flowchart showing a correction value determination sequence according to this embodiment. In this process, an actually measured correction potential value is measured in a similar manner to the reference potential in relation to the photosensitive drum charged to the predetermined correction potential, and a correction value is determined from a difference between the actually measured correction potential value and the reference potential.

S201: The photosensitive drum is driven to rotate, and in this condition, the surface potential of the photosensitive drum is charged to a correction reference potential VC by applying a predetermined charging bias thereto. In this embodiment, the surface potential of the photosensitive drum is charged to 0 V by applying an AC+DC bias and setting the DC bias at 0 V. In this embodiment, VC is set at 0 V, but is not limited thereto, and may be set at any potential enabling stable potential prediction.

S202: A predetermined detection voltage VCh is applied to the transfer roller.

S203: A current value ICh flowing through the photosensitive drum is detected by the current detection portion.

S204: A predetermined detection voltage VCl(1) is applied to the transfer roller.

S205: A current value ICl(1) flowing through the photosensitive drum is detected by the current detection portion.

S206: A predetermined detection voltage VCl(2) is applied to the transfer roller.

S207: A current value ICl(2) flowing through the photosensitive drum is detected by the current detection portion.

S208: {VCl, −ICh} is calculated from a linear relationship between {VCl(1), ICl(1)} and {VCl(2), ICl(2)}.

S209: (VCh+VCl)/2 is set as an actually measured correction potential value VCt.

S210: A difference between the actually measured correction potential value VCt and the correction reference potential VC (0 V) is set as a correction value δV.

Figure 6:
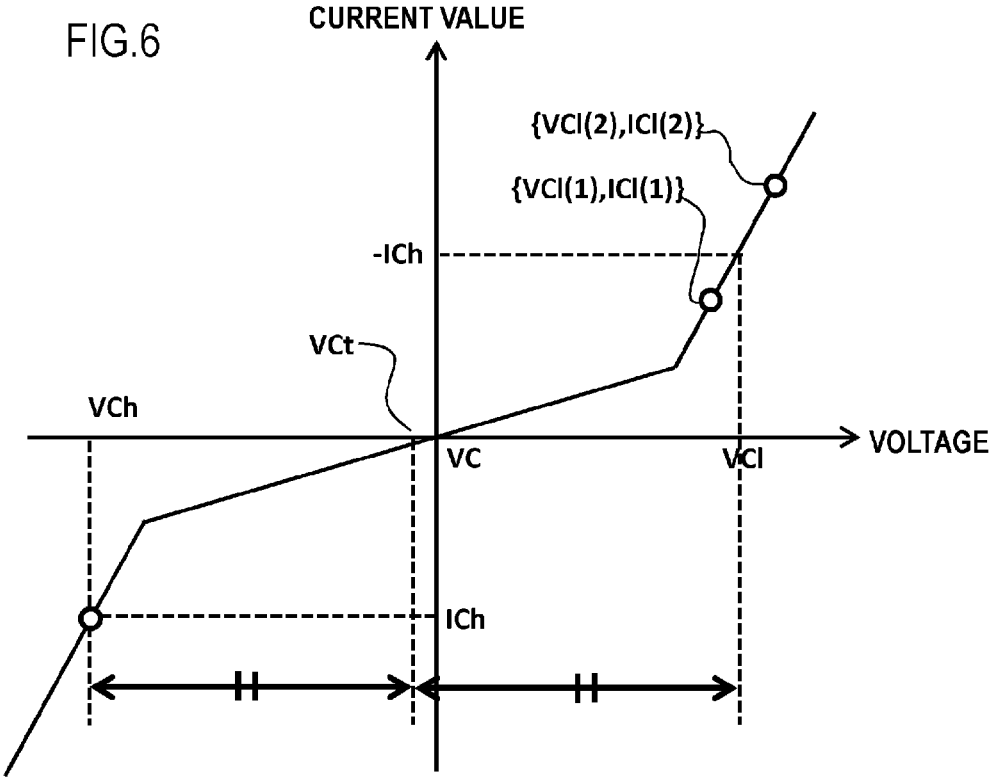
FIG. 6 shows the V-I characteristic of the correction value determination sequence according to the first embodiment.

FIG. 6 shows the V-I characteristic of the correction value determination sequence according to this embodiment. This V-I characteristic differs from the V-I characteristic of the reference potential determination sequence only in that the photosensitive drum is set at the known potential VC (0 V), and therefore identical content will not be described. In this sequence, the voltage value VCt at which the current value flowing through the photosensitive drum reaches zero can be measured in relation to the photosensitive drum charged to the correction reference potential VC (0 V), which is a known potential. By setting the difference between VCt and VC (0 V) as the correction value and correcting the reference potential determined in the reference potential measurement sequence, the surface potential of the photosensitive drum during the reference potential measurement sequence can be learned with a high degree of precision.

Next, the reason why the correction value is required will be described.

According to a discharge characteristic of a photosensitive drum, a potential difference required for discharge varies according to the environment, differences in a film thickness of the photosensitive drum, and so on, but when a uniform electric field is formed between the transfer roller and the photosensitive drum, the potential difference required to start discharge exhibits positive-negative symmetry. However, when the surface of the transfer roller takes a foamed shape, for example, a polarity effect appears in the discharge phenomenon. This phenomenon, which is familiar as a polarity effect occurring in a non-uniform electric field, occurs in the form of unevenness in the potential difference required to start discharge in a non-uniform electric field formed between a transfer roller having a foamed shape and a planar photosensitive drum, for example. Therefore, the polarity effect must be taken into consideration particularly when the transfer roller takes a foamed shape or when a factor that impedes formation of an ideal uniform electric field is present.

In this embodiment, a transfer roller having a foamed shape is used, but it is known that during repeated use of the transfer roller, the transfer roller is pressed and compacted, leading to variation in the foamed shape. It is also known that the condition of fuzz formed during manufacture of the transfer roller varies, leading to variation in a surface profile of the transfer roller. Variation in the surface profile of the transfer roller is considered to be unidirectional variation, and therefore the correction value also varies unidirectionally. However, the inventors have discovered through committed research that when other material such as paper dust and toner adheres to the transfer toner as disturbing substance, the correction value varies. The reason for this is believed to be that due to variation in the shape and electric characteristics caused by the disturbing substance, variation occurs in the condition of the non-uniform electric field that is formed between the transfer roller and the photosensitive drum when the detection bias is applied, and as a result, the polarity effect also varies.

Furthermore, when a sequence for measuring the discharge phenomenon, such as the reference potential determination sequence or the correction value determination sequence, is implemented in a condition where disturbing substance is adhered in a particularly large amount, the condition of the disturbing substance may vary during the sequence. For example, when the transfer roller is contaminated with toner or paper dust following jam processing or the like, some of the toner adhered to the transfer roller maybe ejected during the sequence, leading to variation therein. Hence, when the V-I characteristic is measured, a V-I characteristic having a different polarity effect is obtained depending on the measurement point, and as a result, the precision decreases.

In this embodiment, therefore, the transfer roller is cleaned before the reference potential measurement sequence. The transfer roller is also cleaned before the correction value measurement sequence. Here, the transfer roller can be cleaned by implementing a process of applying, to the transfer roller, a bias having an opposite polarity to the bias applied during image formation for at least one full rotation of the transfer roller. The transfer roller is a roller member provided on an apparatus frame body or a cartridge frame body to be free to rotate (i.e. to be capable of rotating), and the opposite polarity bias is applied continuously to the transfer roller for at least one full rotation so that discharge generated in response to the opposite polarity bias extends over the entire periphery thereof. The bias serves to eject toner and material charged to the same polarity as the toner from the transfer roller onto the photosensitive drum. Further, material charged to the opposite polarity to the toner and toner charged to the opposite polarity can be ejected in a similar manner by respectively applying biases having an identical polarity and an opposite polarity to the bias applied to the transfer roller during image formation.

Moreover, in this embodiment, the transfer roller is used as the voltage application member for detecting the surface potential, but even when another member is used, disturbing substance adheres thereto, and therefore use of another member as the transfer roller is within the scope of this embodiment. For example, likewise when the charging roller or an additional member is used, an external additive added to the toner, paper dust, shavings from the photosensitive drum, other suspended matter in the apparatus, and so on must be taken into account.

Figure 1:
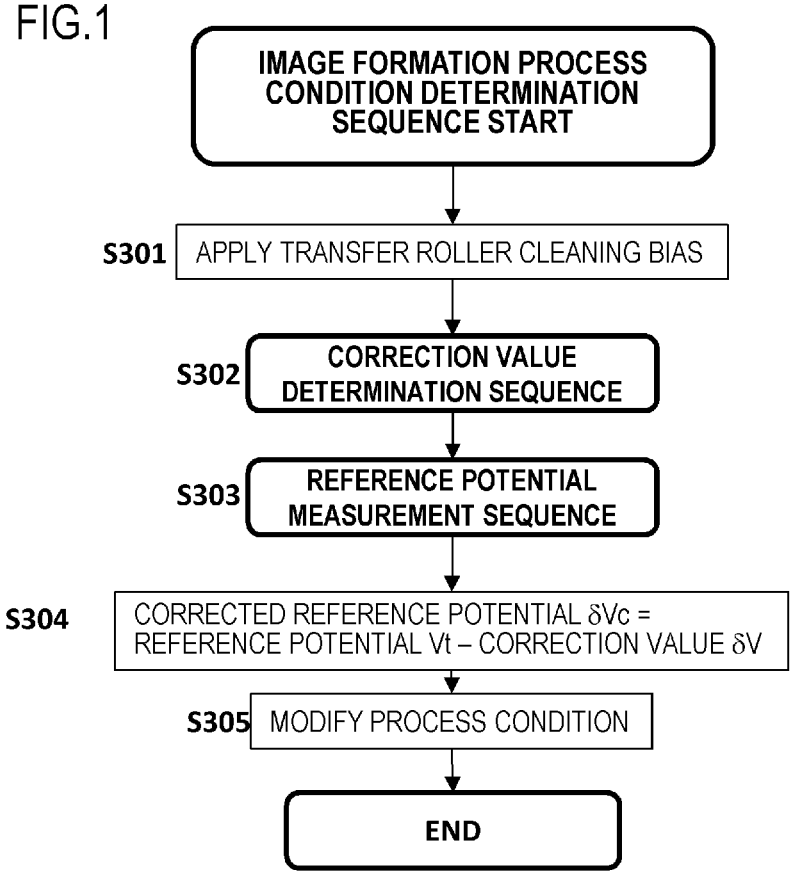
FIG. 1 shows an image formation process condition determination sequence according to a first embodiment.

(5) Image Formation Process Condition Determination (5-1) Process for Determining Image Formation Process Condition FIG. 1 is a flowchart showing a method of determining an image formation process condition according to this embodiment. A flow for determining the image formation process condition, which is implemented when image formation is not underway, will be described in detail below using FIG. 1.

S301: A predetermined cleaning bias voltage is applied to the transfer roller. In this embodiment, the predetermined cleaning bias voltage has an opposite polarity to an image formation bias voltage applied during image formation.

S302: The correction value determination sequence described above in (4) is implemented. As a result, the correction value $\delta V$ is determined.

S303: The reference potential measurement sequence described above in (3) is implemented. As a result, the reference potential Vt is determined.

S304: $Vt-\delta V$ is set as a corrected reference potential Vtc.

S305: The process condition is determined by comparing a preset table expressing a relationship between Vtc and the process condition with Vtc obtained in S305, whereupon an image formation process is started.

In this embodiment, the amount of light emitted during the exposure process is employed as the process condition. For example, the table is set such that the amount of light is increased when Vtc is large due to the increased likelihood of image lightening, and such that the amount of light is reduced when Vtc is small so as to prevent excessive toner from being supplied, leading to excessive toner consumption. Any other process condition relating to image formation, such as the charging bias or the developing bias, maybe used as the image formation process condition instead of the amount of light.

By implementing the process described above, variation in the polarity effect due to disturbing substance on the transfer roller can be prevented from occurring during the sequences, and as a result, the corrected reference potential can be determined with a high degree of precision. The image formation process condition can then be determined on the basis of the corrected reference potential.

Figure 7:
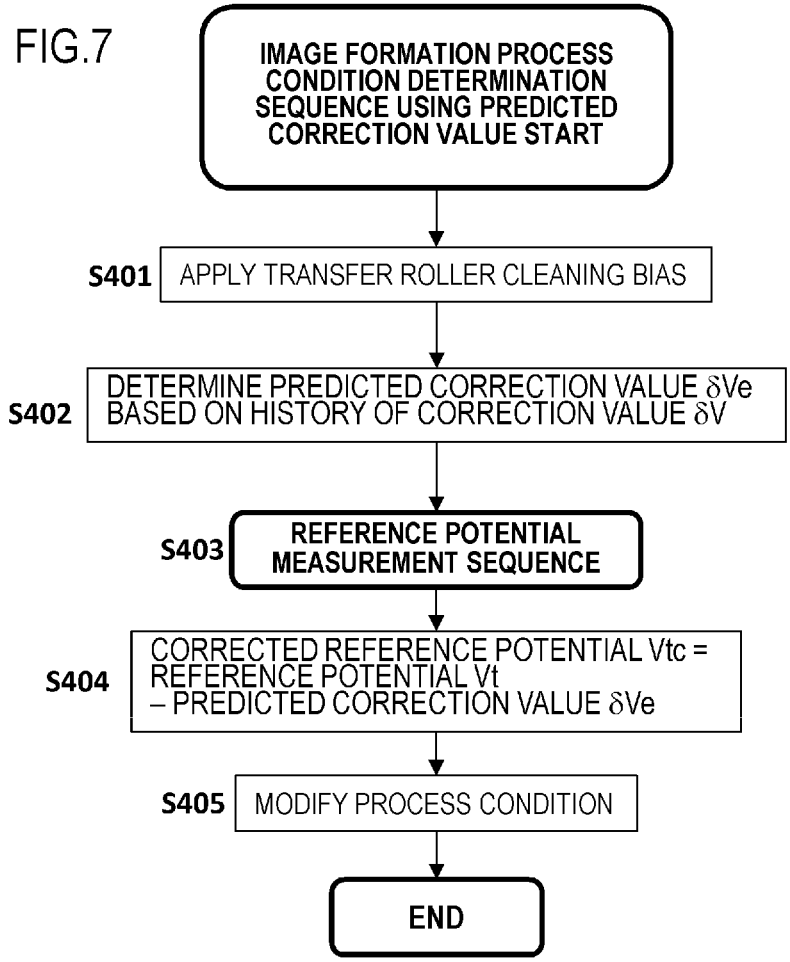
FIG. 7 shows an image formation process condition determination sequence using a predicted correction value, according to the first embodiment.

(5-2) Process for Determining Image Formation Process Condition Using Predicted Correction In this embodiment, to reduce the amount of time a user must wait while image formation is not underway and reduce the discharge time of the photosensitive drum, thereby suppressing scraping of the photosensitive drum, the correction value determination sequence is omitted and a sequence for determining the image formation process condition using a predicted correction is introduced. FIG. 7 is a flowchart showing the sequence for determining the image formation process condition using a predicted correction, according to this embodiment.

S401: A predetermined cleaning bias is applied to the transfer roller. In this embodiment, a bias having an opposite polarity to the bias applied during image formation is applied.

S402: A predicted correction value $\delta Ve$ is determined on the basis of a history of the correction value determined in the correction value determination sequence by implementing predetermined calculation processing. For example, in the calculation processing, a latest correction value is calculated predictively from a variation tendency or the like of a plurality of correction values calculated in the past. In this embodiment, the latest correction value δV is set as the predicted correction value, but instead, for example, the correction value may be calculated on the basis of variation in the shape of the transfer roller using the correction value of the transfer roller when new and the latest correction value. Further, for example, a table of predicted correction values determined by measuring variation in the correction value by experiment or the like may be prepared in advance in the storage portion, and the predicted correction value may be selected (obtained) from the table in accordance with an amount of use of the transfer roller.

S403: The reference potential measurement sequence described above in (3) is implemented. As a result, the reference potential Vt is determined.

S404: Vt−δVe is set as the corrected reference potential Vtc.

S405: The process condition is determined by comparing the preset table expressing the relationship between Vtc and the process condition with Vtc obtained in S305, whereupon the image formation process is started.

Detailed description of parts of (5-2) that are identical to (5-1) has been omitted.

In this embodiment, by implementing either the image formation process condition determination sequence or the image formation process condition determination sequence using a predicted correction depending on conditions, the reference potential can be measured with a high degree of precision and such that the wait time of the user is minimized, whereupon image formation can be performed.

(6) Disturbing Substance Transferred Amount Prediction

Figure 8:
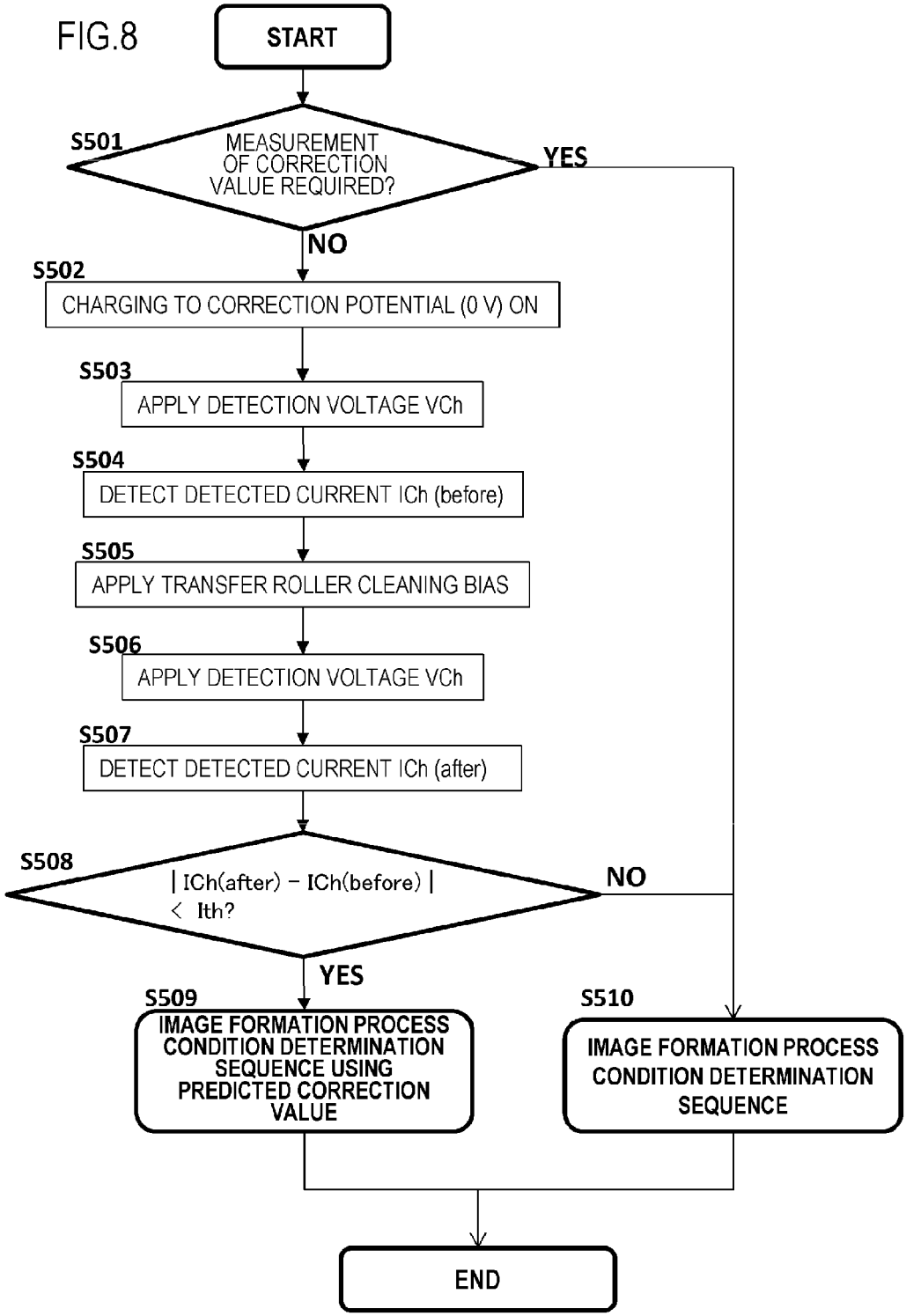
FIG. 8 shows a disturbing substance transferred amount prediction sequence according to the first embodiment.

FIG. 8 is a flowchart showing a disturbing substance transferred amount prediction sequence. Next, disturbing substance transferred amount prediction, which is a feature of this embodiment, will be described using FIG. 8.

S501: A determination is made as to whether or not it is necessary to measure the correction value. When measurement is necessary, the sequence advances to S510. After determining that it may be possible to use the predicted correction value, the sequence advances to S502. The correction value varies in response to variation in the polarity effect, which advances as the transfer roller is repeatedly used, and therefore, in this embodiment, control is performed to reassess the condition of the transfer roller every time 1000 sheets are printed.

S502: The photosensitive drum is driven to rotate, and in this condition, the surface potential of the photosensitive drum is charged to VC by applying the predetermined charging bias thereto. In this embodiment, the surface potential of the photosensitive drum is charged to 0 V by applying an AC+DC bias and setting the DC bias at 0 V.

S503: The predetermined detection voltage VCh (a voltage having a first applied voltage value) is applied to the transfer roller.

S504: A current value ICh (before) (a first detected current value) flowing through the photosensitive drum is detected by the current detection portion.

S505: The predetermined cleaning bias is applied to the transfer roller. In this embodiment, a bias having an opposite polarity to the bias applied during image formation is applied.

S506: The predetermined detection voltage VCh (the voltage having the first applied voltage value) is applied to the transfer roller.

S507: A current value ICh (after) (a second detected current value) flowing through the photosensitive drum is detected by the current detection portion.

S508: When an absolute value of ICh (after)−Ich (before) is smaller than a predetermined threshold Ith, the sequence advances to S509. When the absolute value equals or exceeds the threshold, the sequence advances to S510.

S509: The image formation process condition determination sequence using a predicted correction, described above in (5-2), is implemented to determine the process condition.

S510: The image formation process condition determination sequence described above in (5-1) is implemented, whereby the process condition is determined more slowly than in S509.

Here, the control performed in S503 to S508 will be described in more detail.

Figure 9:
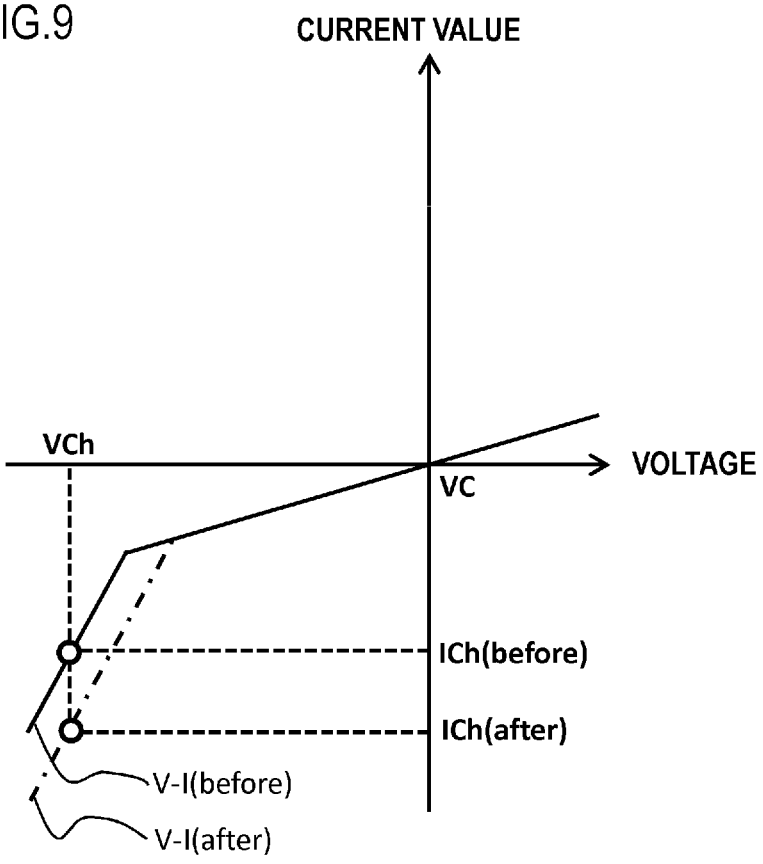
FIG. 9 shows the V-I characteristic of the disturbing substance transferred amount prediction sequence according to the first embodiment.

FIG. 9 shows the V-I characteristic during disturbing substance transferred amount prediction according to this embodiment. When disturbing substance has been transferred onto the transfer roller, the V-I characteristic before the transfer roller is cleaned corresponds to V-I (before) in FIG. 9, and the V-I characteristic after the transfer roller is cleaned corresponds to V-I (after) in FIG. 9. The respective V-I characteristics have different discharge start voltages, and it can therefore be seen that the V-I characteristic following discharge is different.

In this embodiment, using the characteristic described above, variation in the polarity effect before and after the transfer roller is cleaned is detected from variation in the detected current value when VCh is applied. Accordingly, when variation in the current value equals or exceeds the threshold Ith, it is assumed that the condition of the transfer roller will vary after the transfer roller is cleaned, leading to variation in the polarity effect. This indicates that at least a fixed amount of disturbing substance has been transferred onto the transfer roller, and at the same time that at least a fixed amount of the disturbing substance has been removed by cleaning the transfer roller. In other words, this indicates that disturbing substance not fully removed in the cleaning operation may remain. However, the predicted correction value does not take into account remaining disturbing substance, and therefore, when the predicted correction value is used, the precision of the correction decreases. To solve this problem, control for implementing the image formation process condition determination sequence is performed when the current value difference equals or exceeds Ith such that the correction value is measured anew. In this embodiment, this series of sequences is implemented at intervals of 200 fed sheets, but the implementation frequency may be modified depending on the frequency with which it is envisaged that disturbing substance will be transferred.

FIG. 10 shows relationships between the transfer roller in various conditions and the correction value δV.

It is known that as the transfer roller is used repeatedly, the polarity effect decreases, leading to a reduction in the correction value. This phenomenon is due to variation in the shape of the transfer roller, and therefore, by measuring or envisaging variation in the shape of the transfer roller in advance, the correction value can be corrected. It is also known that the polarity effect decreases when the transfer roller is contaminated with toner, but by cleaning the transfer roller, the polarity effect can be increased. It is therefore acknowledged to be beneficial to measure the correction value after cleaning the transfer roller in order to eliminate the effects of contamination. Moreover, since the correction value varies, it maybe possible to implement the disturbing substance transferred amount prediction sequence shown in FIG. 8.

Further, it is evident from FIG. 10 that although the polarity effect increases following cleaning, the polarity effect does not return to the same level as that prior to contamination. Hence, when disturbing substance has been transferred, it is necessary to consider variation in the correction value. In this embodiment, control is performed to measure the actual correction value in consideration of these circumstances, and therefore this embodiment can also be employed effectively in a case where the correction value varies in response to the transfer of disturbing substance.

Furthermore, the sequence shown in FIG. 1 takes 20 seconds, and the sequence shown in FIG. 7 takes 12 seconds. It is therefore evident that this embodiment, in which one of the sequences is selected as required, is effective in terms of a time reduction.

By employing the configurations of this embodiment, as described above, a precise correction value can be used regardless of whether or not disturbing substance is present, and by employing the predicted correction value, the reference potential can be measured while minimizing the wait time of the user. Highly precise image formation can then be performed on the basis of the measurement result of the reference potential.

Second Embodiment

In the first embodiment, the disturbing substance transferred amount is predicted by applying a detection voltage before and after cleaning the transfer roller, measuring variation occurring in the current value at that time, and predicting disturbing substance transfer on the assumption that variation has occurred in the discharge start voltage. In a second embodiment of the present invention, on the other hand, disturbing substance transfer is predicted on the basis of a use history of the image forming apparatus. In the second embodiment, description of matter that is identical to the first embodiment has been omitted, and only features that differ from the first embodiment will be described.

Here, the use history of the image forming apparatus, which serves as a feature of this embodiment, includes the existence of a jam history, a ratio of the number of consecutively fed sheets to the number of printed sheets, and a feeding history of small sized sheets. During normal image formation, the paper serving as the recording material is disposed between the transfer roller and the photosensitive drum, and therefore the toner on the photosensitive drum is not transferred directly onto the transfer roller. When a jam occurs, however, the transfer roller and the photosensitive drum may come into direct contact while the toner image is on the photosensitive drum, and therefore disturbing substance may be transferred onto the transfer roller. Further, when printing is performed by feeding sheets consecutively (when images are formed consecutively on the recording material), it may be difficult to clean away the toner on the photosensitive drum sufficiently. At this time, when two sheets are fed consecutively, for example, scumming may occur on the photosensitive drum between the first and second fed sheets. In this case, the photosensitive drum and the transfer roller come into direct contact such that disturbing substance is transferred onto the transfer roller. Hence, when the ratio of the number of consecutively fed sheets to the number of printed sheets is higher than a predetermined ratio, the amount of disturbing substance transferred onto the transfer roller may increase beyond the predicted amount. Moreover, when small sized sheets are fed during printing, the transfer roller and the photosensitive drum come into direct contact over a large surface area during image formation, and therefore, if scumming is present on the photosensitive drum, disturbing substance may be transferred onto the transfer roller. In other words, when the number of printed sheets includes a large proportion of small sized printed sheets, the amount of disturbing substance transferred onto the transfer roller may increase beyond the predicted amount.

Hence, in this embodiment, the following three conditions are used as predetermined conditions that must be satisfied before calculating the surface potential using the predicted correction value.

(1) A recording material jam has not occurred following calculation of the previous correction value.

(2) The ratio of the number of small sized sheets of recording material (recording material no larger than a predetermined size) subjected to image formation to the total number of sheets of recording material subjected to image formation after calculating the previous correction value does not reach a predetermined threshold. In this embodiment, 5%, for example, is set as the threshold when postcard-size sheets of recording material are fed in a configuration where the maximum size of the recording material that can be fed in a vertical direction is LTR size. In other words, the number of printed sheets of postcard-size recording material must make up less than 5% of the printing history following measurement of the previous correction value.

(3) The ratio of the number of sheets of recording material subjected to image formation by means of consecutive image formation, in which images are formed consecutively on a plurality of sheets of recording material, to the total number of sheets of recording material subjected to image formation after calculating the precious correction value does not reach a predetermined threshold. In this embodiment, 50%, for example, is set as the predetermined threshold. In other words, the total number of images printed during consecutive image formation must make up less than 50% of the printing history following measurement of the previous correction value.

When these three conditions are satisfied, it is assumed that the amount of disturbing substance transferred onto the transfer roller has not varied greatly, and therefore the surface potential can be calculated using the predicted correction value. In other words, the sequence for measuring the actual correction value is omitted, and the surface potential is calculated on the basis of the predicted correction value.

Note that the surface potential may be calculated using the predicted correction value when at least one of these conditions (1), (2), and (3) is satisfied. Furthermore, the above conditions are merely examples, and other conditions may be used.

Figure 11:
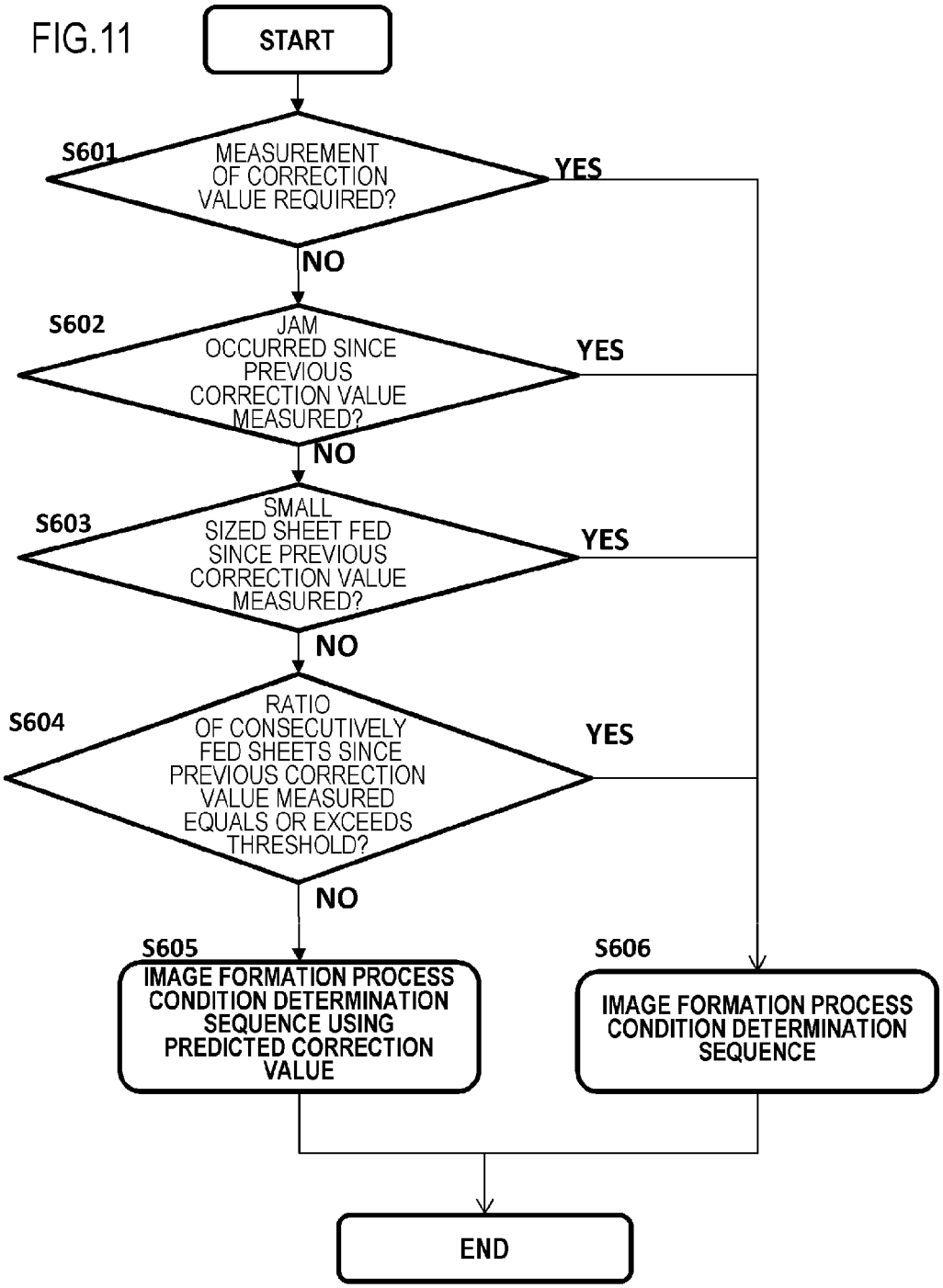
FIG. 11 shows a disturbing substance transferred amount prediction sequence according to a second embodiment.

FIG. 11 is a flowchart showing a disturbing substance transferred amount prediction sequence according to the second embodiment.

S601: A determination is made as to whether or not it is necessary to measure the correction value. When measurement is necessary, the sequence advances to S510. After determining that it may be possible to use the predicted correction value, the sequence advances to S502. The correction value varies in response to variation in the polarity effect, which advances as the transfer roller is repeatedly used, and therefore, in this embodiment, control is performed to reassess the condition of the transfer roller every time 1000 sheets are printed.

S602: When a jam has not occurred since the previous correction value was measured, the sequence advances to S606.

S603: When a small sized sheet has been fed since the previous correction value was measured, the sequence advances to S606.

S604: When the ratio of the number of consecutively fed sheets to the number of fed sheets since the previous correction value was measured equals or exceeds the predetermined threshold, the sequence advances to S606.

S605: The image formation process condition determination sequence using a predicted correction, described above in (5-2), is implemented to determine the process condition.

S606: The image formation process condition determination sequence described above in (5-1) is implemented, whereby the process condition is determined more slowly than in S605.

By employing the configurations of this embodiment, as described above, a precise correction value can be used regardless of whether or not disturbing substance is present, and by employing the predicted correction value, the reference potential can be measured while minimizing the wait time of the user. Highly precise image formation can then be performed on the basis of the measurement result of the reference potential.

Note that the configurations of the embodiments described above may be employed in all possible combinations.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-044552, filed Mar. 6, 2015, which is hereby incorporated by reference herein in its entirety.

What is claimed is:

1. An image forming apparatus comprising:

an image bearing member;

a charging portion that charges the image bearing member;

an exposure portion that exposes a surface of the charged image bearing member;

a developing portion that forms a toner image on the image bearing member by supplying toner to an electrostatic latent image formed on the surface of the image bearing member;

a voltage application member that applies a voltage to the image bearing member in response to a voltage applied to the voltage application member;

a voltage application portion that applies the voltage to the voltage application member;

a current detection portion that detects a current value flowing through the image bearing member;

a potential detection portion that determines a surface potential of the image bearing member on the basis of an applied voltage value of a detection voltage applied to the voltage application member by the voltage application portion and a detected current value detected by the current detection portion in response to the applied voltage; and a control unit that sets an image formation condition for performing image formation in order to form the toner image on the image bearing member on the basis of the surface potential determined by the potential detection portion, wherein, when the surface potential is to be determined by the potential detection portion, the voltage application portion applies the detection voltage after applying, to the voltage application member, a voltage having an opposite polarity to an image formation voltage that is applied to the voltage application member during image formation, and wherein when determining the surface potential, the potential detection portion:

sets, as an actually measured correction potential value, a potential that is determined by having the voltage application portion apply a voltage to the voltage application member after the voltage application portion has applied the voltage having the opposite polarity to the image formation voltage to the voltage application member and the charging portion has charged the image bearing member using a predetermined charging bias in order to set the surface potential of the image bearing member at a correction reference potential; and sets a difference between the actually measured correction potential value and the correction reference potential as a correction value.

2. The image forming apparatus according to claim 1, wherein after setting the correction value, the potential detection portion sets, as a reference potential, a potential that is determined by having the voltage application portion apply a voltage to the voltage application member after the charging portion has charged the image bearing member using a predetermined charging bias and the exposure portion has exposed the surface of the image bearing member to a predetermined amount of light, and the potential detection portion sets a potential obtained by correcting the reference potential by the correction value as the surface potential.

3. The image forming apparatus according to claim 2, wherein the surface potential is derived using the correction value when a used amount of the voltage application member has reached a predetermined value.

4. The image forming apparatus according to claim 1, further comprising a transfer member that transfers, to a transfer object, a toner image formed on the image bearing member when a voltage is applied to the image bearing member, wherein the transfer member is the voltage application member.

5. The image forming apparatus according to claim 1, wherein a used amount of the voltage application member is determined in accordance with the number of sheets of recording material subjected to image formation.

6. The image forming apparatus according to claim 1, wherein the voltage application member is a rotatable roller member, and the voltage having the opposite polarity to the image formation voltage is applied until the voltage application member completes at least one full rotation.

7. An image forming apparatus comprising:

an image bearing member;

a charging portion that charges the image bearing member;

an exposure portion that exposes a surface of the charged image bearing member;

a developing portion that forms a toner image on the image bearing member by supplying toner to an electrostatic latent image formed on the surface of the image bearing member;

a voltage application member that applies a voltage to the image bearing member in response to a voltage applied to the voltage application member;

a voltage application portion that applies the voltage to the voltage application member;

a current detection portion that detects a current value flowing through the image bearing member;

a potential detection portion that determines a surface potential of the image bearing member on the basis of an applied voltage value of a detection voltage applied to the voltage application member by the voltage application portion and a detected current value detected by the current detection portion in response to the applied voltage; and a control unit that sets an image formation condition for performing image formation in order to form the toner image on the image bearing member on the basis of the surface potential determined by the potential detection portion, wherein, when the surface potential is to be determined by the potential detection portion, the voltage application portion applies the detection voltage after applying, to the voltage application member, a voltage having an opposite polarity to an image formation voltage that is applied to the voltage application member during image formation, and wherein when determining the surface potential, the potential detection portion:

sets, as a reference potential, a potential that is determined by having the voltage application portion apply a voltage to the voltage application member after the voltage application portion has applied the voltage having the opposite polarity to the image formation voltage to the voltage application member; and sets a potential obtained by correcting the reference potential by a predicted correction value determined in advance in accordance with a used amount of the voltage application member as the surface potential.

8. The image forming apparatus according to claim 7, wherein the surface potential is derived using the predicted correction value when the used amount of the voltage application member has not reached a predetermined value.

9. The image forming apparatus according to claim 7, wherein the potential detection portion:

sets, as an actually measured correction potential value, a potential that is determined by having the voltage application portion apply a voltage to the voltage application member after the voltage application portion has applied the voltage having the opposite polarity to the image formation voltage to the voltage application member and the charging portion has charged the image bearing member using a predetermined charging bias in order to set the surface potential of the image bearing member at a correction reference potential;

sets a difference between the actually measured correction potential value and the correction reference potential as a correction value;

after setting the correction value, sets, as a reference potential, a potential that is determined by having the voltage application portion apply a voltage to the voltage application member after the charging portion has charged the image bearing member using a predetermined charging bias and the exposure portion has exposed the surface of the image bearing member to a predetermined amount of light; and sets a potential obtained by correcting the reference potential by the correction value as the surface potential, the predicted correction value being determined on the basis of a plurality of the correction values determined in the past and a used amount of a new voltage application member.

10. The image forming apparatus according to claim 9, wherein the surface potential is derived using the correction value when the used amount of the new voltage application member has reached a predetermined value.

11. The image forming apparatus according to claim 9, wherein when determining the surface potential, the potential detection portion:

determines an absolute value of a difference between a first detected current value and a second detected current value, the first detected current value being detected by the current detection portion when the voltage application portion applies a voltage to the voltage application member at a first applied voltage value after the charging portion has charged the image bearing member using a predetermined charging bias, and the second detected current value being detected by the current detection portion when the voltage application portion applies a voltage to the voltage application member at the first applied voltage value after the first detected current value has been detected and the voltage application portion has applied the voltage having the opposite polarity to the image formation voltage to the voltage application member;

derives the surface potential using the predicted correction value when the absolute value is smaller than a predetermined threshold; and derives the surface potential using the correction value when the absolute value equals or exceeds the predetermined threshold.

12. The image forming apparatus according to claim 9, wherein when determining the surface potential, the potential detection portion derives the surface potential using the predicted correction value when a predetermined condition is satisfied, the predetermined condition including at least one of the following conditions:

(1) a recording material jam has not occurred after deriving a previous correction value;

(2) a ratio of the number of sheets of recording material no larger than a predetermined size that have been subjected to image formation after deriving the previous correction value does not reach a predetermined threshold; and (3) a ratio of the number of sheets of recording material subjected to image formation by means of consecutive image formation, in which images are formed consecutively on a plurality of sheets of recording material, to a total number of sheets of recording material subjected to image formation after deriving the previous correction value does not reach a predetermined threshold.

* * * * *